US007873165B2

(12) United States Patent
Richards, IV et al.

(10) Patent No.: US 7,873,165 B2
(45) Date of Patent: Jan. 18, 2011

(54) TACTICAL RADIO WITH INTEGRATED SATCOM CAPABILITY

(75) Inventors: Charles Richards, IV, Melbourne, FL (US); Tim Klembczyk, Rochester, NY (US); Tom Kenney, Rochester, NY (US); George Helm, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 1068 days.

(21) Appl. No.: 11/640,478

(22) Filed: Dec. 15, 2006

(65) Prior Publication Data

US 2008/0144815 A1 Jun. 19, 2008

(51) Int. Cl.
*H04K 1/10* (2006.01)

(52) U.S. Cl. ..... 380/272; 380/33

(58) Field of Classification Search ..... 380/272, 380/33

See application file for complete search history.

(56) References Cited

U.S. PATENT DOCUMENTS

| | | | | |
|---|---|---|---|---|
| 6,771,969 | B1 * | 8/2004 | Chinoy et al. | 455/456.1 |
| 6,904,032 | B2 | 6/2005 | Cain | |
| 7,034,678 | B2 * | 4/2006 | Burkley et al. | 340/539.13 |
| 7,035,585 | B2 | 4/2006 | Forman et al. | |
| 7,071,791 | B1 | 7/2006 | Wilson, III | |
| 7,120,456 | B1 * | 10/2006 | Elliot et al. | 455/517 |
| 7,509,141 | B1 * | 3/2009 | Koenck et al. | 455/552.1 |
| 7,681,036 | B1 * | 3/2010 | Zuber et al. | 713/166 |
| 2004/0052368 | A1 | 3/2004 | Spring et al. | |
| 2004/0052372 | A1 | 3/2004 | Jakoubek | |
| 2006/0236365 | A1 | 10/2006 | Pham | |
| 2006/0239458 | A1 * | 10/2006 | Bicksler et al. | 380/221 |
| 2007/0008927 | A1 * | 1/2007 | Herz et al. | 370/331 |

FOREIGN PATENT DOCUMENTS

| | | |
|---|---|---|
| EP | 0 653 851 | 5/1995 |

OTHER PUBLICATIONS

Jo, Kenneth Y., "Satellite Communications Representation in Network Simulation", 2001 Winter Simulation Conference, pp. 1346-1352.*

"The Future of JTRS" Brochure, [XP-002485883—Retrieved from the Internet] 2002, pp. 1-6.

"AN/PRC117F(C) Type 1 Multiband, Multimission Radio", Data Sheet, [XP-002485884—Retrieved from the Internet] 2007, pp. 1-2.

"AN/PRC117F(C) Type 1 Multiband, Multimission Radio", Applications Book [XP-002485885—Retrieved from the Internet] 2007, pp. 1-31.

* cited by examiner

*Primary Examiner*—Matthew B Smithers
(74) *Attorney, Agent, or Firm*—Harness, Dickey & Pierce, P.L.C.

(57) ABSTRACT

A multi-band radio having seamless satellite communication capability is provided. The radio includes: a user interface for controlling operations of the radio; an encryption module; a LOS wireless transceiver for transmitting encrypted data at a frequency in the radio frequency spectrum; a BLOS wireless transceiver for transmitting encrypted data at a frequency in the microwave frequency spectrum; and a router for routing the encrypted data to at least one of the LOS transceiver and the BLOS transceiver.

19 Claims, 4 Drawing Sheets

TACTICAL RADIO WITH INTEGRATED SATCOM CAPABILITY

FIELD

The present disclosure relates to tactical radio communications and, more particularly, to a tactical radio which provides seamless satellite communication capability.

BACKGROUND

The increased requirement for greater troop mobility has been accommodated by the trend toward multiband, multimode radio systems. While technology permits the production of smaller, lighter-weight radio equipment, overall communications capability has not kept up with the demand. The need for flexibility, security and reliability of terrestrial radio communications remains a critical problem. Two more significant radio limitations are the congested frequency spectrum and the physical limits on radio propagation. The development and use of satellite communication are an attempt to overcome these limitations.

What is needed is a seamless integration of satellite communication capability into conventional tactical radios. The statements in this section merely provide background information related to the present disclosure and may not constitute prior art.

SUMMARY

A multi-band radio having seamless satellite communication capability is provided. The radio includes: a user interface for controlling operations of the radio; an encryption module; a LOS wireless transceiver for transmitting encrypted data at a frequency in the radio frequency spectrum; a BLOS wireless transceiver for transmitting encrypted data at a frequency in the microwave frequency spectrum; and a router for routing the encrypted data to at least one of the LOS transceiver and the BLOS transceiver.

In another aspect of the disclosure, the radio further includes a tactical application that generates tactical awareness data pertaining to the radio, where the router routes the tactical awareness data to the BLOS transceiver when the tactical awareness data fails to reach an intended destination using the LOS transceiver.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
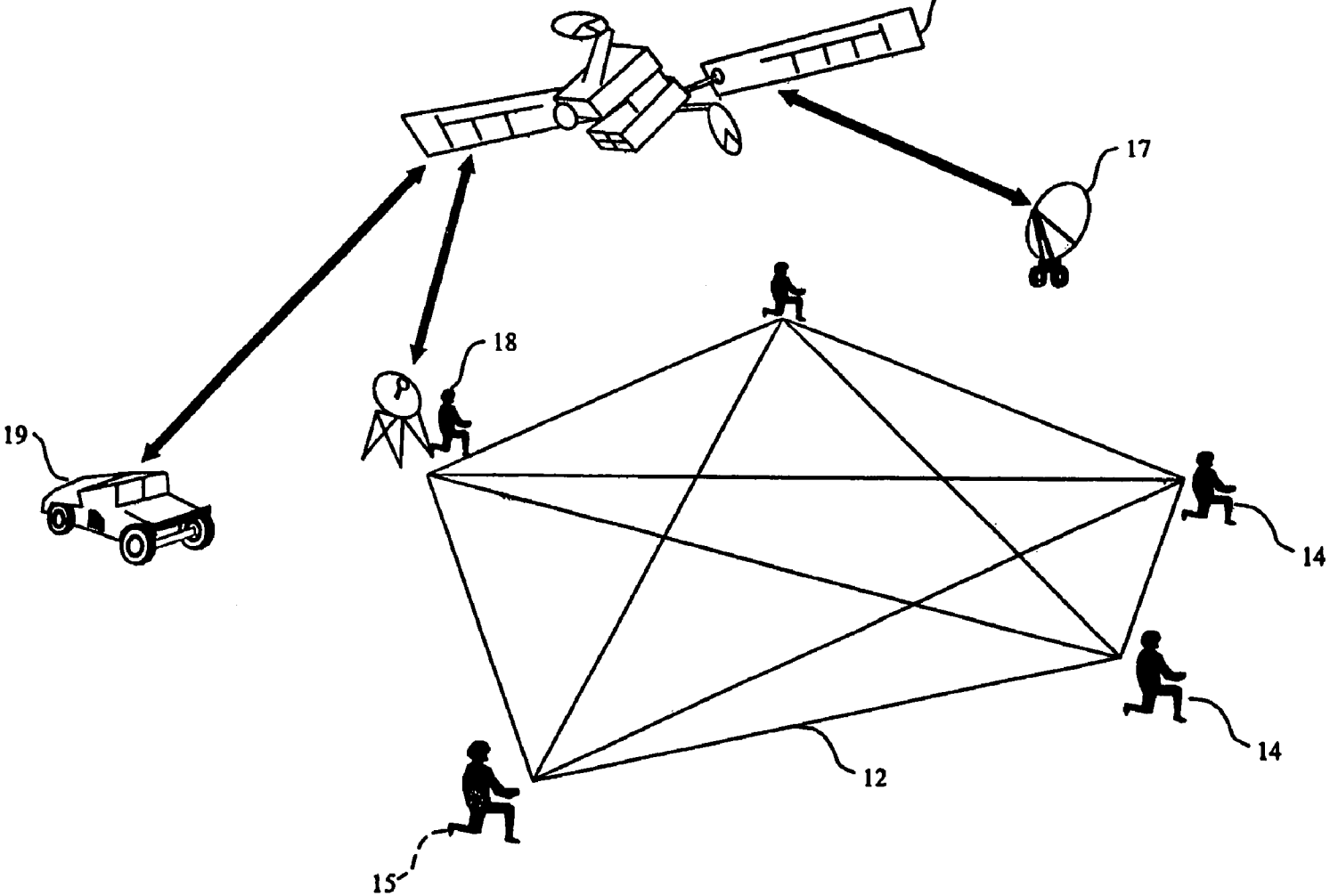
FIG. 1 is a diagram of an exemplary tactical environment in which a tactical radio may be employed.

FIG. 1 illustrates an exemplary tactical environment 10 in which a tactical radio may be employed. In this environment, a secure line-of-sight (LOS) communication network 12 may be established amongst two or more radios 14. Exemplary tactical radios may include a handheld radio or a manpack radio from the Falcon II series of radio products commercially available from Harris Corporation. Other types of radios are also contemplated by this disclosure. In any case, at least one of the radios 15 is equipped with seamless satellite communication capability in the manner further described below. In this way, network traffic may also be routed over a beyond line-of-sight (BLOS) communication link to a satellite 16 which in turn routes network traffic to a tactical operation center 17 or other remote location. The tactical environment may further include a communications-on-the-quick-halt node 18 or a Satcom-on-the-move vehicle node 19. When either of these nodes comes within the LOS communication network 12, network traffic from the network can also be routed via these nodes to the tactical operation center.

Figure 2:
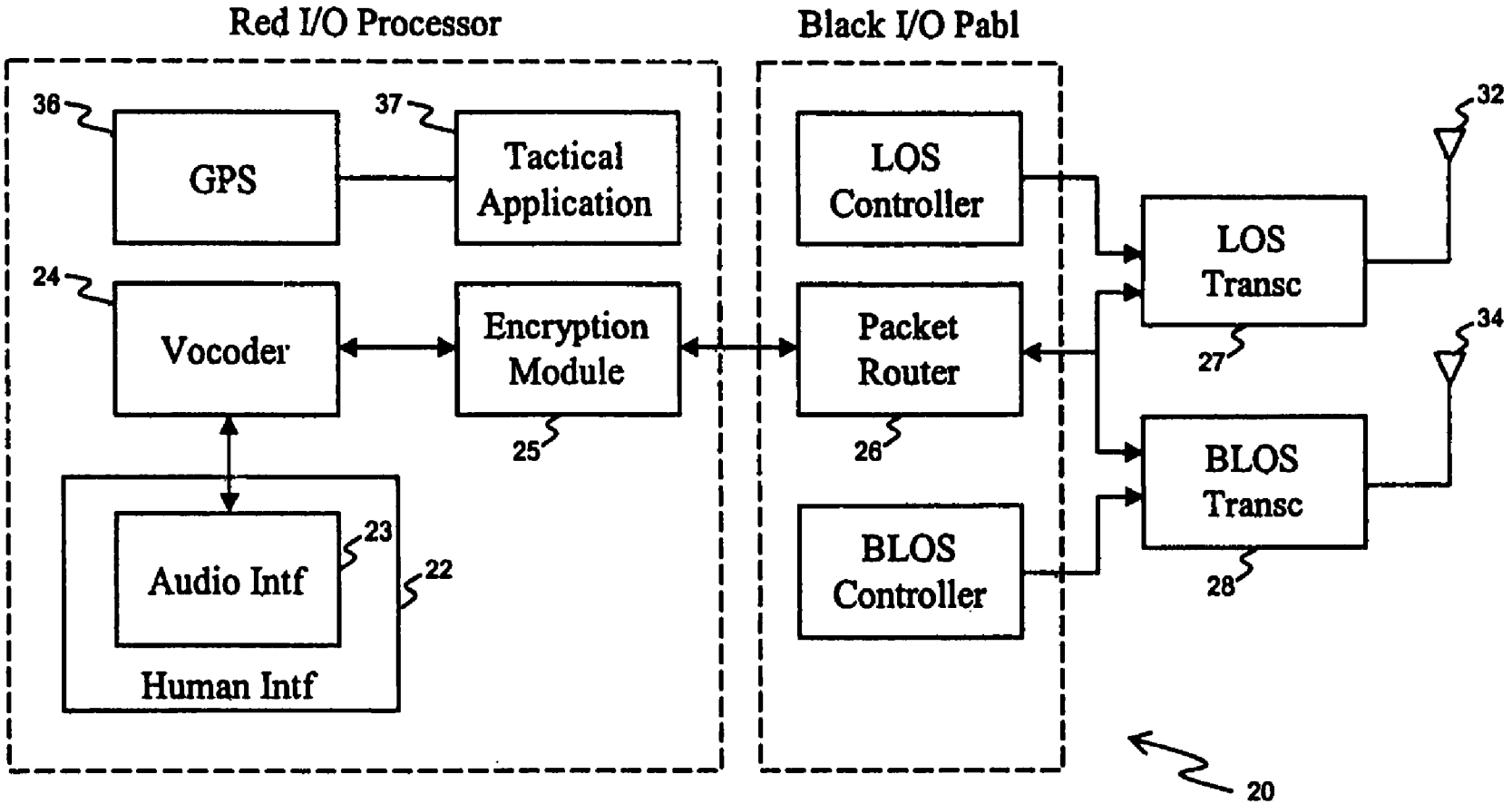
FIG. 2 is a block diagram of a radio having a seamlessly integrated satellite communication capability.

FIG. 2 depicts an exemplary configuration for a radio 20 having a seamlessly integrated satellite communication capability. The radio 20 is comprised generally of a human interface 22, an encryption module 24, a packet router 26, and at least two transceivers 27, 28. One of the transceivers is configured to transmit data over a wireless communication link at a frequency in the radio frequency spectrum, such as the tactical VHF/UHF spectrum, (referred to herein as LOS transceiver); whereas, the other transceiver is configured to transmit data over a wireless communication link at a frequency in the microwave frequency spectrum, such as the Satcom spectrum, (referred to herein as BLOS transceiver). Each of these radio components, along with other preferred components, is further described below. It is to be understood that only the relevant components are discussed below, but that other known components (e.g., power source) are needed to control and manage the overall operation of the radio. Within the broader aspects of the disclosure, it is also envisioned that these components may be arranged in other varying configurations.

The human interface 22 enables the radio operator to control the operations of the radio. For instance, the human interface 22 includes an audio interface 23 for capturing voice data from the radio operator and outputting voice data to the radio operator. Such audio interfaces are well known in the art. The human interface 22 also provides an interface to configure operating parameters of the transceivers. For example, the operator may select at which frequency a transceiver will operate at. In another example, the interface may enable the operator to select which transceiver is used to transmit data. The design also permits the ability to use the radio as a telephone, dialing, the phone number of any globally existing phone number. The phone number is entered via the front panel, and this phone number is transferred across the BLOS link to the network, which provides a telephony gateway into either a secured VoIP network using the radios embedded encryption, or a secured phone call into the public switched telephone network (PSTN). This allows direct telephony connections between a plain old telephone system (POTS) phone and a radio user.

Voice data from the audio interface is routed through an encryption module to ensure secure communication. The encryption device 25 is operable to encrypt and decrypt messages. Although various algorithms are contemplated, the encryption module 25 preferably employs a Sierra Type 1 or a Citadel encryption algorithm. Prior to being encrypted, voice data may pass through a vocoder 24 which digitizes the voice data and then segments it into data packets for subsequent transmission. The data packets are defined in accordance with the Internet protocol or some other type of network routing protocol. In this way, data packets may be routed amongst the transceivers as well as to different nodes in the network. However, it is contemplated that data need not be sent in packet form.

A packet router 26 is interposed between the encryption module and the transceivers 27, 28. The packet router 26 functions in a manner similar to a conventional multi-interface IP router to route outbound data packets to either one or both of the transceivers 27, 28. It is understood that the radio may be part of an ad-hoc LOS network and; therefore, the packet router will dynamically maintain available nodes in a routing table in accordance with known techniques. Likewise, incoming data packets may be redirected by the router 26 to one of the transceivers. For example, data packets received via a LOS transceiver 27 may be re-routed to the BLOS transceiver 28 for transmission. The radio in this design provides a LOS-BLOS gateway, allowing simplified connectivity between radios with only a LOS transceiver, and a remote LAN accessible by only the BLOS transceiver. Connectivity between a LOS radio outstation and the remote LAN will be allowed using security associations setup to insure authorized access.

The LOS transceiver 27 is configured to receive data packets from the router and transmit the data packets over a wireless communication link at a frequency in the radio frequency spectrum. In an exemplary embodiment, the LOS transceiver is a VHF network module that operates in the frequency range from 30 MHz to 108 MHz and is commonly employed in military grade radios. Alternatively, the LOS transceiver could be a UHF network module that operates in the frequency range of 300 MHz to 3 GHz. It is readily understood that other types of transceivers which operate within the radio frequency spectrum fall within the scope of this disclosure.

Similarly, the BLOS transceiver 28 is configured to receive data packets from the router, but transmits the data packets over a wireless communication link at a frequency in the microwave frequency spectrum. In an exemplary embodiment, the BLOS transceiver 28 is a Broadband Global Area Network (BGAN) transceiver module which operates in the L-band and is commercially available from Immarsat. While a commercially available satellite communication service is presently contemplated, it is understood that the communication link may be established using a proprietary communication service. Likewise, it is contemplated that other types of BLOS transceivers at various frequency bands may be employed, including transceivers which operate in other portions of the microwave spectrum, such as the C, X, Ku or Ka band.

The radio 20 is equipped with an antenna 32 which is coupled to the LOS transceiver 27. It is envisioned that the antenna may be detachable or permanently coupled to the radio. A directional antenna 34 is also needed for use with the BLOS transceiver 28*r*. Therefore, the radio is further equipped with an interface port for detachably coupling a directional antenna to the radio.

In one exemplary scenario, the radio operator carries a directional antenna or an omni-directional 34 along with the portable radio. During radio operation, the operator may encounter the need for BLOS transmissions. The operator will then couple the manually steered directional antenna or the omni-directional antenna to the interface port and point the antenna towards a desired satellite. The operator is informed of the precise compass bearing and elevation to aim the directional antenna based on positional information received by the GPS module.

In another exemplary scenario, the portable radio 20 may be situated in a vehicle, on the move, having steerable directional antenna or an omni-directional antenna. In this case, the radio 20 is coupled via the interface port to the antenna. During operation, the radio will seamlessly route data to either the LOS transceiver 27 or the BLOS transceiver 28. The BLOS transceiver 28 will in turn route data, along with steering commands, through the interface port to the direction antenna. It is noteworthy that the radio interface 22 as well as the BLOS transceiver 28 is contained within a single portable enclosure.

The radio 20 further includes a global positioning system (GPS) module 36 and one or more tactical applications 37. The GPS module 36 is adapted to receive a timestamp as well as positional information in a manner well known in the art. The tactical application 37 generates tactical awareness data pertaining to the radio. For instance, the tactical application 37 may interface with the GPS module 36 to determine current positional information for the radio. This positional information is in turn embedded in data packets for transmission to a tactical command center. In another instance, the radio 20 may be configured to detect when the radio operator encounters a perilous situation such as nearby explosions or gunfire. In this instance, the tactical application 37 may formulate a message regarding the perilous situation for transmission to a tactical command center. Other types of tactical awareness data are also contemplated by this disclosure. In any instance, tactical awareness data is routed to the encryption module and then onto the router for transmission from the radio.

Figure 3:
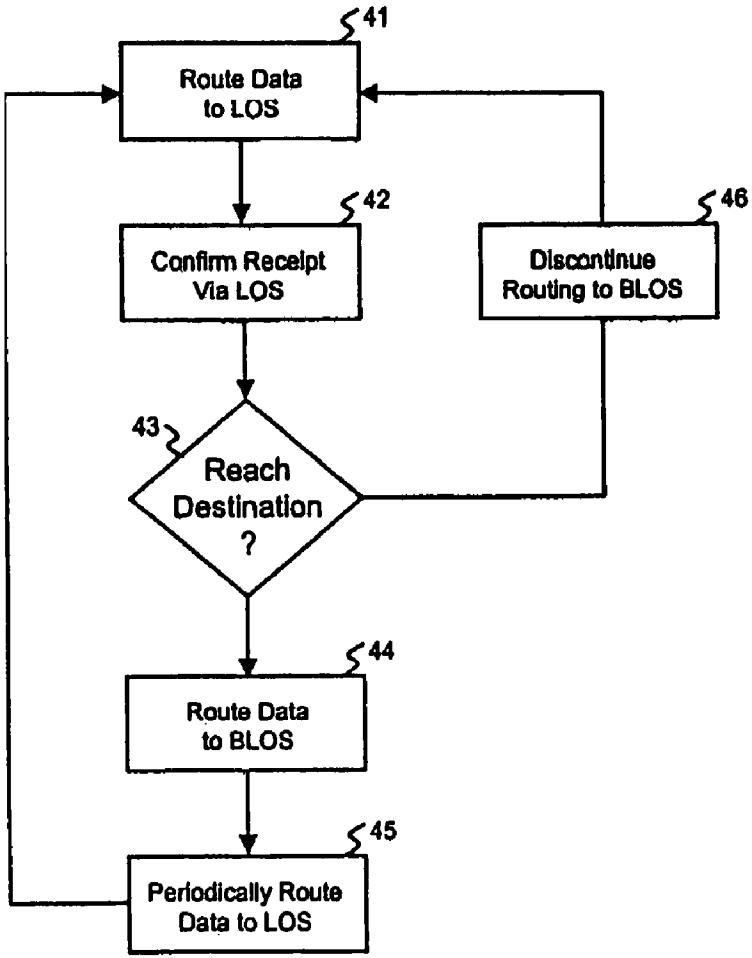
FIG. 3 is a flowchart depicting an exemplary routing scheme which may be employed by the radio.

During operation, voice data and tactical awareness data may be routed amongst the transceivers employed by the radio as shown in FIG. 3. Although some data packets are merely broadcast across the network, it is understood that some data packets are intended to be routed to a particular destination. In some instances, the intended destination for a data packet resides in the LOS network. Therefore, all data packets in this exemplary routing scheme are initially routed at 41 to the LOS transceiver for transmission across the network. Routing data primarily within the LOS network reduces the expense associated with a commercial satellite link, if applicable.

In other instances, the intended destination for a data packet resides outside of the LOS network. For example, tactical awareness data is preferably intended for a tactical command center which is remote from the LOS network. At the tactical command center, the tactical awareness data is received by a situational awareness software application which is configured to display the data in real-time and preferably in a geographical context, such as on a map. Since a radio may not be equipped with a BLOS transceiver or not presently configured to use it (e.g., directional antenna not available), data packets are first routed to the LOS transceiver as indicated above. Data packets intended for the tactical command center may then encounter another radio within the LOS network which is able to transmit the data packets to the command center. In this way, data packets are routed via an intermediary in the LOS network to their intended destination outside of the LOS network.

To ensure delivery, the router may be configured to confirm receipt (e.g., acknowledgement message) of data 42 sent by the LOS transceiver to an intended destination. When data packets fail to reach their intended destination, the router will begin routing data packets to the BLOS transceiver as indicated at 44. When an antenna 34 compatible with the BLOS transceiver is available to the radio, the router will automatically route data packet to the BLOS transceiver for transmission. When an antenna 34 compatible with the BLOS transceiver is not available to the radio, the radio operator may be notified via the human interface 22 to attach a compatible antenna 34. In addition, the human interface may display an indication of the received signal strength level which enables the operator to optimally point an antenna toward a satellite. In a preferred embodiment, data packets containing tactical awareness data are routed to the BLOS transceiver, while other types of data packets, such as voice data, continue to be routed exclusively to the LOS transceiver. In a more robust routing scheme, only data packets having the same intended destination as the data packets which failed to reach their intended destination are routed to the BLOS transceiver.

In an exemplary embodiment, the router 26 may queue data packets sent via the LOS transceiver 27 until receipt from the intended destination is received. Upon confirming receipt, applicable data packets can be deleted from the queue. When data packets fail to reach the intended destination, the router may re-transmit the queued data packets using the BLOS transceiver 28. Alternatively, the router 26 may not re-transmit data packets, but merely direct newly received data packets to the BLOS transceiver 28.

Furthermore, data packets may continue to be periodically transmitted at 45 using the LOS transceiver. The router also confirms receipt of these data packets by the intended destination. In this way, the radio is able to determine when the communication link to the intended destination becomes available. Once the communication link becomes available, the router discontinues routing data packets to the BLOS transceiver at 46 and resumes routing the data packets to the LOS transceiver.

While the above described routing scheme is suitable for all types of data packets, it is envisioned that the routing scheme may only be applied to a select group of data packets, such as tactical awareness data. It is understood that different types of data packets may be distinguished by an identifier in the packer header. Similarly, the routing scheme may only be applied to data packets having a particular destination (i.e., IP address).

Data packets may also be routed amongst the transceivers based on attributes (e.g., signal-to-noise ratio) associated with the links established by the transceivers. In a likely scenario, the LOS network may become congested, thereby deteriorating the SNR for transmissions using the LOS transceiver. In this case, the router may monitor the SNR over a given link and route data packets from one transceiver to the other transceiver when the SNR decreases below defined threshold. It is envisioned that other link attributes may be used by the router when selecting which transceiver to use.

Figure 4:
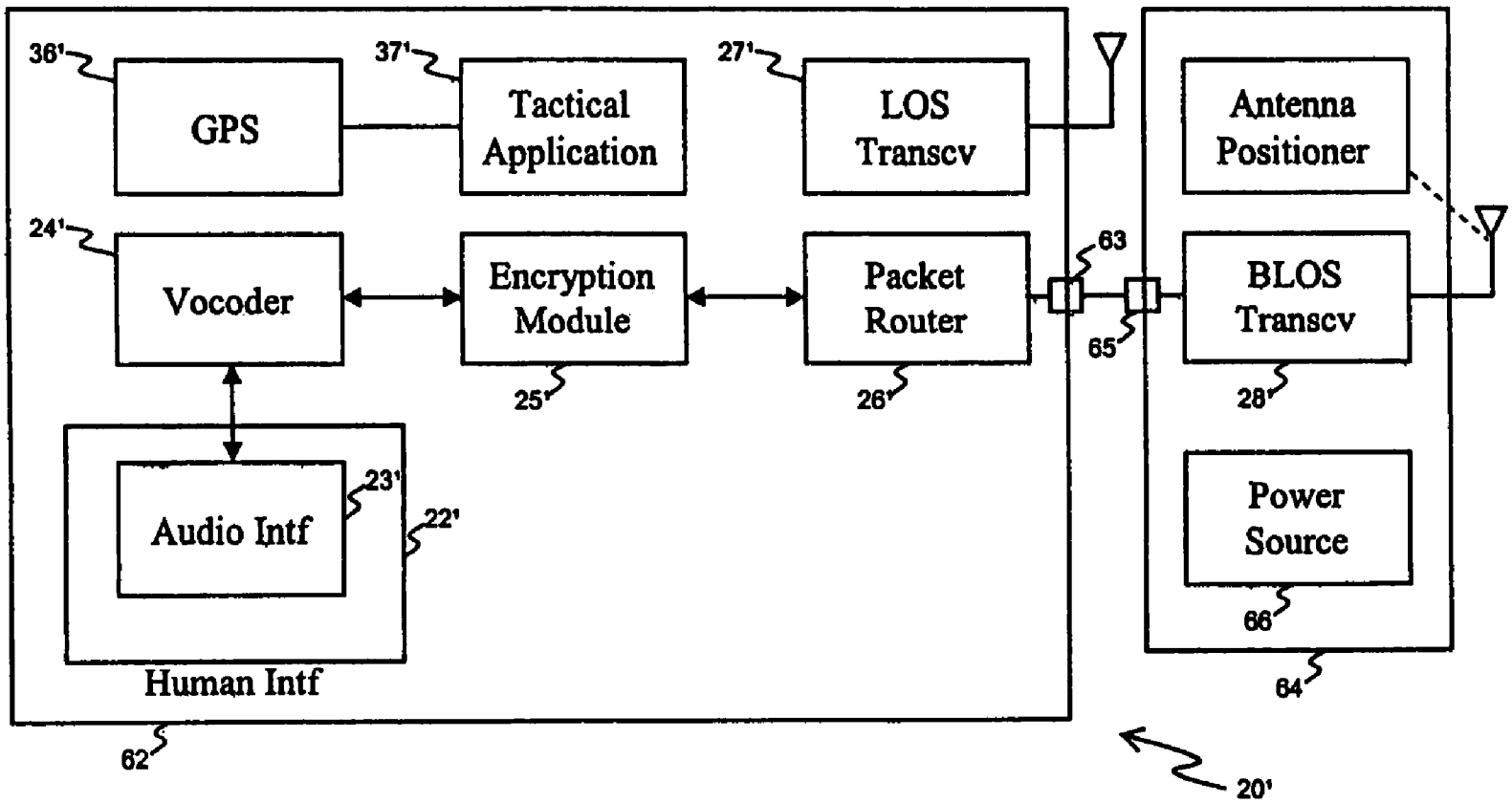
FIG. 4 is a block diagram of an alternative configuration for a radio having a seamlessly integrated satellite communication capability.

FIG. 4 depicts another exemplary configuration for a radio 20' having a seamlessly integrated satellite communication capability. In this configuration, the radio interface 22', the encryption module 24', the packet router 26', and the LOS transceiver 27' are contained in a primary radio housing 62. Unless otherwise defined below, each of these radio components and any other needed radio components are the same as described above.

A secondary housing 64 is then provided for the BLOS transceiver 28'. The BLOS transceiver 28' may be directly coupled to a directional antenna 34' or configured to detachably couple to a directional antenna 34' in the manner described above. The primary and secondary radio housings 62, 64 each provide an external port 63, 65 for connecting to the other. When coupled together, the packet router 26' in the primary radio housing 62 is able to directly route data packets to the BLOS transceiver 28' in the secondary radio housing 64. To do so, the router 26' is operable to detect the presence of the connection to the BLOS transceiver 28' and seamlessly route data packets to the BLOS transceiver only when it is connected to the router. It is noteworthy that operational parameters for the BLOS transceiver 28' are controlled through the human radio interface 22' on the primary radio housing 62. During operation, the BLOS transceiver 28' may rely on the power source residing in the primary radio housing 62. Alternatively, the secondary housing 64 may contain an independent power source 66 for powering the BLOS transceiver 28'.

The above description is merely exemplary in nature and is not intended to limit the present disclosure, application, or uses.

What is claimed is:

1. A multi-band radio, comprising:

a user interface for controlling operations of the radio;

a radio controller configured to generate tactical awareness data that specifying a geographic position for the radio;

an encryption module configured to receive data from the user interface and the tactical awareness data from the radio controller and operable to encrypt the data;

a LOS wireless transceiver configured to receive encrypted data and to transmit the encrypted data at a frequency in the radio frequency spectrum;

a BLOS wireless transceiver configured to receive encrypted data and to transmit the encrypted data at a frequency in the microwave frequency spectrum; and a router configured to receive the encrypted data from the encryption module and operable to route the encrypted data to at least one of the LOS transceiver and the BLOS transceiver.

2. The multi-band radio of claim 1 wherein the user interface is configured to enables an operator to configure operating parameters of the LOS transceiver and the BLOS transceiver.

3. The multi-band radio of claim 1 wherein the user interface is configured to enables an operator to select which transceiver the encrypted data is routed to by the router.

4. The multi-band radio of claim 1 further comprises an audio interface configured for receiving voice data from an operator, and the encryption module is configured to receive the voice data as an input.

5. The multi-band radio of claim 1 wherein the tactical awareness data includes global positioning coordinates for the radio.

6. The multi-band radio of claim 5 wherein the router is configured to route the tactical awareness data to the LOS transceiver while the tactical awareness data is reaching its intended destination and configured to route the tactical awareness data to the BLOS transceiver when the tactical awareness data fails to reach intended destination using the LOS transceiver.

7. The multi-band radio of claim 1 further comprises a directional antenna detachably coupled to an interface port of the radio, wherein the BLOS transceiver interfaces with the directional antenna to transmit data.

8. The multi-band radio of claim 7 further comprises a global positioning system (GPS) embedded in the radio and the user interface is configured to provide information for pointing the antenna to a radio operator based on positional data from the GPS.

9. The multi-band radio of claim 1 wherein the BLOS transceiver transmits in a frequency range of 8 GHz to 60 GHz.

10. The multi-band radio of claim 1 further comprises a battery which is integrated with the radio components in a portable enclosure.

11. The multi-band radio of claim 1 wherein the user interface, the encryption module, the router and the LOS transceiver reside in a portable enclosure and the BLOS transceiver resides in a different enclosure that is detachably coupled by a wired connection to an output port of the portable enclosure, and the router is configured to route the encrypted data directly from the router over the wired connection to the BLOS transceiver.

12. The multi-band radio of claim 1 wherein the user interface, the encryption module, the router and the LOS transceiver reside in a portable enclosure having a portable power source and the BLOS transceiver resides in a different enclosure having a different power source.

13. A multi-band radio, comprising:

an audio interface configured to receive voice data from an operator;

a radio controller configured to generate tactical awareness data having an intended destination and specifying global positioning coordinates for the radio;

an encryption module configured to receive the voice data and the tactical awareness data and generate encrypted data;

a LOS transceiver configured to receive the encrypted data and to transmit the encrypted data at a frequency in the radio frequency spectrum;

a BLOS transceiver configured to receive encrypted data and to transmit the encrypted data at a frequency in the microwave frequency spectrum; and a router configured to receive the encrypted data from the encryption module and operable to route the encrypted data to at least one of the LOS transceiver and the BLOS transceiver, wherein the router routes the voice data and the encrypted tactical awareness data to the LOS transceiver so long as the encrypted tactical awareness data is reaching the intended destination and further routes the tactical awareness data to the BLOS transceiver when the tactical awareness data fails to reach the intended destination using the LOS transceiver while continuing to route the voice data to the LOS transceiver.

14. The multi-band radio of claim 13 wherein the router is configured to discontinue routing of tactical awareness data to the LOS transceiver while routing the tactical awareness data to the BLOS transceiver.

15. The multi-band radio of claim 13 wherein the router is configured to periodically route a portion of the tactical awareness data to the LOS transceiver while routing the tactical awareness data to the BLOS transceiver and to discontinue routing tactical awareness data to the BLOS transceiver when the tactical awareness data reaches an intended destination using the LOS transceiver.

16. The multi-band radio of claim 13 further comprises a packet converter configured to receive the voice data from the audio input and to generate data packets which contain the voice data in accordance with an Internet protocol.

17. The multi-band radio of claim 13 further comprises a directional antenna detachably coupled to an interface port of the radio, wherein the BLOS transceiver interfaces with the directional antenna to transmit data.

18. The multi-band radio of claim 17 further comprises a global positioning system (GPS) embedded in the radio and the user interface is configured to provide information for pointing the antenna to a radio operator based on positional data from the GPS.

19. A multi-band radio, comprising:

an audio interface configured to receive voice data from an operator;

an encryption module configured to receive the voice data and generate encrypted data;

a LOS transceiver configured to receive the encrypted data from the encryption module and to transmit the encrypted data over a wireless communication link at a frequency in the radio frequency spectrum, wherein the LOS transceiver is further configured to receive tactical awareness data having an intended destination over the wireless communication link;

a BLOS transceiver configured to receive encrypted data and to transmit the encrypted data at a frequency in the microwave frequency spectrum; and a router configured to receive the voice data and the tactical awareness data and to route the voice data and tactical awareness data to the LOS transceiver so long as the tactical awareness data is reaching the intended destination, the router further configured to route the tactical awareness data to the BLOS transceiver when the tactical awareness data fails to reach the intended destination using the LOS transceiver.

* * * * *